US007373995B2

(12) United States Patent
Hughes et al.

(10) Patent No.: US 7,373,995 B2
(45) Date of Patent: May 20, 2008

(54) METHOD AND APPARATUS FOR DRILLING CURVED BOREHOLES

(76) Inventors: William James Hughes, 6619 E. 114th St., Bixby, OK (US) 74008; Gary Marshall Briggs, 15119 River Park, Houston, TX (US) 77070

( * ) Notice: Subject to any disclaimer, the term of this patent is extended or adjusted under 35 U.S.C. 154(b) by 110 days.

(21) Appl. No.: 11/287,912

(22) Filed: Nov. 28, 2005

(65) Prior Publication Data

US 2007/0119629 A1 May 31, 2007

(51) Int. Cl.
*E21B 7/08* (2006.01)

(52) U.S. Cl. ..... 175/61; 175/73

(58) Field of Classification Search ..... 175/61, 175/73, 76, 325.1

See application file for complete search history.

(56) References Cited

U.S. PATENT DOCUMENTS 3,298,449 A * 1/1967 Bachman et al. ..... 175/76
5,293,945 A * 3/1994 Rosenhauch et al. .... 175/325.2
5,941,321 A 8/1999 Hughes ..... 175/61

* cited by examiner

*Primary Examiner*—William P Neuder
(74) *Attorney, Agent, or Firm*—Rudolf O. Siegesmond; Gordon & Rees LLP

(57) ABSTRACT

The invention is an improved rotary steerable tool. The improved rotary steerable tool comprises a control tube that slides vertical within a mandrel in response to changes in drilling fluid pressure, thereby opening and closing a channel between the mandrel and a piston chamber in a rotationally isolated sleeve. With the channel open, a piston in the piston chamber is exposed to the drilling fluid. When the drilling pressure is sufficient to cause the piston to move, the piston forces a deflection pad outward. After the deflection pad engages a borehole wall, any additional increases in pressure force the opposing side of sleeve toward the opposite wall, thereby tilting the direction of any attached drill bit. An optional guide lug and alignment sleeve orient the deflection pad with respect to other components.

13 Claims, 13 Drawing Sheets

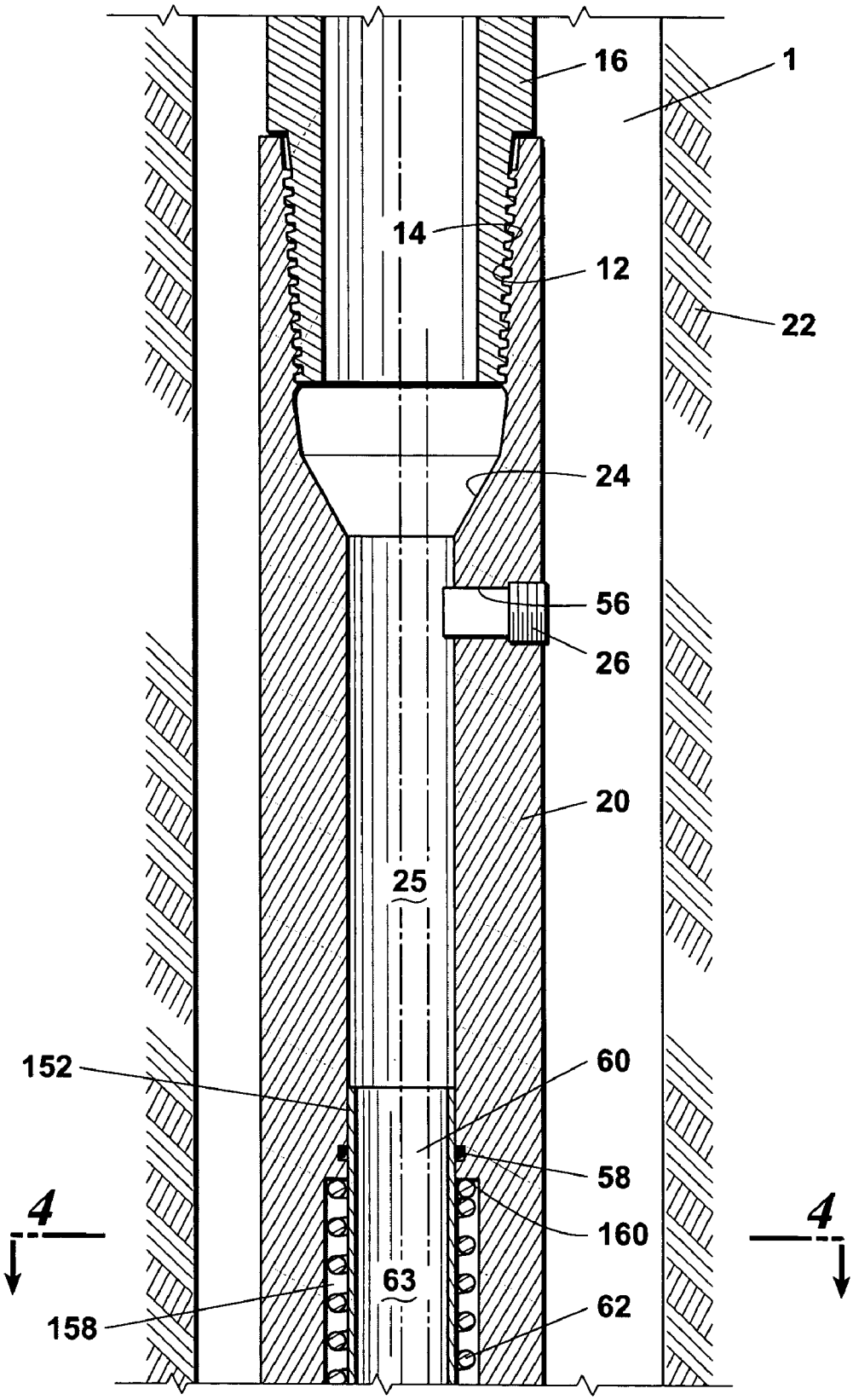
*Fig. 3A* *TO FIGURE 3B*

FROM FIGURE 3A
1
22
158
63
20
152
62
28
30
27
86
88
68
70
72
5
5
74
76
78
90
92
61
80
82
96
94
84
32
60
36
156
154
40
104
98
102
6A
6A
106
108
110
38
120
100
122
34
112
124
114
126
118
118
20
44
44
25
50

METHOD AND APPARATUS FOR DRILLING CURVED BOREHOLES

CROSS-REFERENCE TO RELATED APPLICATION

The present invention is an improvement over the invention disclosed and claimed in my prior U.S. Pat. No. 5,941,321, issued Aug. 24, 1999 on a "METHOD AND APPARATUS FOR SHORT RADIUS DRILLING OF CURVED BOREHOLES."

FIELD OF THE INVENTION

This invention is related to a method and apparatus for boring a hole in the earth, or in material having similar characteristics. More particularly, this invention relates to an apparatus for boring a hole having at least one non-linear segment.

BACKGROUND OF THE INVENTION

Horizontal drilling technology has come a long way in the past 20 years, and is now an accepted drilling method that has numerous benefits for the recovery of hydrocarbons. Horizontal drilling can be used as both an exploration tool and as a completion technique. The benefits of horizontal drilling when used as part of a completion method include increased drainage area, connecting fracture permeability to the well bore, and reducing drawdown pressures. There also is a strong desire in the industry to reduce the surface foot print caused by drilling activities, and horizontal drilling has proven to be an effective means of reducing the number of wells required to develop a field.

Horizontal drilling is critical for exploiting reservoirs that have little to no primary permeability. To achieve maximum productivity, a horizontal well can be oriented in a particular direction to maximize the number of fractures that the well intersects. By connecting fractures to a well bore, horizontal drilling has been able to turn economically unproductive reservoirs into economic successes. Vertical wells have a much lower probability than horizontal wells of repeatedly intersecting fractures, because nearly all fractures are vertically oriented. A properly placed horizontal well also has been shown to dramatically lower the drawdown pressure across the face of the well bore, and, thus, horizontal drilling also can be applied to water drive reservoirs to eliminate coning.

Generally, a horizontal well comprises at least three distinct segments. First, a vertical borehole extends from the surface to a desired depth beneath the surface, at which point a second, non-linear (i.e. "curved") borehole transitions the vertical borehole to a third borehole segment (i.e. the "horizontal" segment). The orientation of the third borehole segment, though, depends upon the curvature of the second segment. Thus, the third segment is not necessarily horizontal. In principle, the curvature of the second segment can be adjusted to drill a hole to any desired subsurface location or strata. In practice, though, steering a drill bit with sufficient precision to create the desired curvature has proven difficult.

Typical motor-driven, bottom-hole assemblies have a bent housing that tilts the axis of the drill bit to drill a curved borehole. The orientation of the obtuse angle created by the fixed bend is known as "tool face." The rigid bend in the drill string points the face of the drill bit in a direction that is tangential to the longitudinal axis of the drill string. But because the bent housing is a fixed part of the drill string, a curved hole can be drilled with these conventional devices only when the drill string is not rotating. Consequently, the technique that uses this type of device is commonly referred to as "slide drilling."

U.S. Pat. No. 5,941,321 (issued Aug. 24, 1999) describes a "rotary steerable" drilling tool that overcomes some of the disadvantages associated with the conventional slide drilling tools, and permits significantly faster penetration rates because of better hole cleaning. The rotary steerable tool is an apparatus for drilling curved boreholes, particularly in applications that require short radius curvatures, commonly referred to in the art as an "aggressive build rate." The rotary steerable tool of the '321 patent includes a sliding tube mounted for sliding movement within the central bore of the drill pipe sub-assembly. The upper end of the sliding tube is provided with a tapered throat that makes the sliding tube responsive to pressure from fluid flowing through the drill string. Fluid pressure pushes a deflection device against the side of the borehole, urging the lower end of the drill string to be tilted away from the longitudinal axis of the borehole above the drill bit such that the drill bit will tend to drill in a direction away from the longitudinal axis of the borehole. A knuckle joint also can be included in the drill string between the rotary steerable tool and the drill bit, which can decrease the radius of curvature of a non-linear borehole.

While the rotary steerable tool disclosed in the '321 patent overcomes many disadvantages of the conventional slide drilling procedures, there still remains room for improvement. In particular, the tapered throat on the upper end of the sliding tube restricts the flow of drilling fluid as it passes through the drill string. Such a fluid restriction can increase the pressure above the tool and adversely affect the bit hydraulics, requiring more powerful and more expensive fluid pumps to compensate for the restriction. Additionally, the rotation of the drill pipe tends to cause the eccentric sleeve of the tool to rotate within the borehole, which can cause the deflection device to collapse or steer the drill bit in an undesired direction.

SUMMARY OF THE INVENTION

It is an object of the present invention to provide a rotary steerable tool that improves the flow characteristics of drilling fluid within the tool, and improves the isolation of the tool from the rotational forces of the drill string.

The invention described in detail below is an improved rotary steerable tool for steering an earth-penetrating drill bit. The improved rotary steerable tool comprises an eccentric sleeve having a cylindrical bore and a piston chamber; a piston spring positioned within the piston chamber so that one end of the piston spring engages the piston chamber; a piston that engages the piston spring; a deflection pad mounted to the piston through a port in the piston chamber; a mandrel positioned in the eccentric sleeve, the mandrel having a slot that exposes a bore in the mandrel to the mandrel's external surface; a control spring positioned in the mandrel; and a control tube positioned in the coiled control spring and the mandrel so that the control spring engages the tube and exerts a force on the control tube that urges the control tube vertically downward. In response to increasing pressure of drilling fluid in the mandrel, the control tube moves upward against the force of the control spring and exposes the piston to the drilling fluid through the slot in the mandrel. In turn, the piston responds to the pressure of the drilling fluid and causes the deflection pad to move outward and engage the borehole wall. Internal bearings isolate the eccentric sleeve and the deflection pad from the mandrel, thus allowing the mandrel to rotate freely without exerting any rotational force on the eccentric sleeve. External bearing assemblies strategically placed above and below the eccentric sleeve further isolate the mandrel and the eccentric sleeve from the borehole surfaces.

Additionally, a guide lug fixed to the control tube engages the slot in the mandrel and an alignment sleeve mounted to the eccentric sleeve. In response to increasing pressure of drilling fluid in the mandrel, the guide lug, so fixed to the control tube, moves upwardly in the slot to a position above the tip of the alignment sleeve, so that the mandrel rotates freely. In response to subsequent decreasing pressure of drilling fluid in the mandrel, the guide lug moves downwardly and engages the alignment sleeve, so that the eccentric sleeve—mounted to the alignment sleeve—rotates to a known position with respect to the mandrel.

BRIEF DESCRIPTION OF DRAWINGS

The novel features believed characteristic of the invention are set forth in the appended claims. The invention itself, however, as well as a preferred mode of use, further objectives and advantages thereof, will be understood best by reference to the following detailed description of an illustrative embodiment when read in conjunction with the accompanying drawings, wherein:

FIG. 3A' depicts a view similar to FIG. 3A showing the changed positions of certain elements as a result of an increased fluid pressure in the drill string;

FIG. 3B' depicts a view similar to FIG. 3B showing the changed positions of certain elements as a result of an increased fluid pressure in the drill string;

DETAILED DESCRIPTION OF THE PREFERRED EMBODIMENT

As used herein, "fluid" means a source or means of supplying pressure and shall include without limitation hydraulic fluid, water, high-pressure compressed air, and similar sources of pressure.

Figure 1:
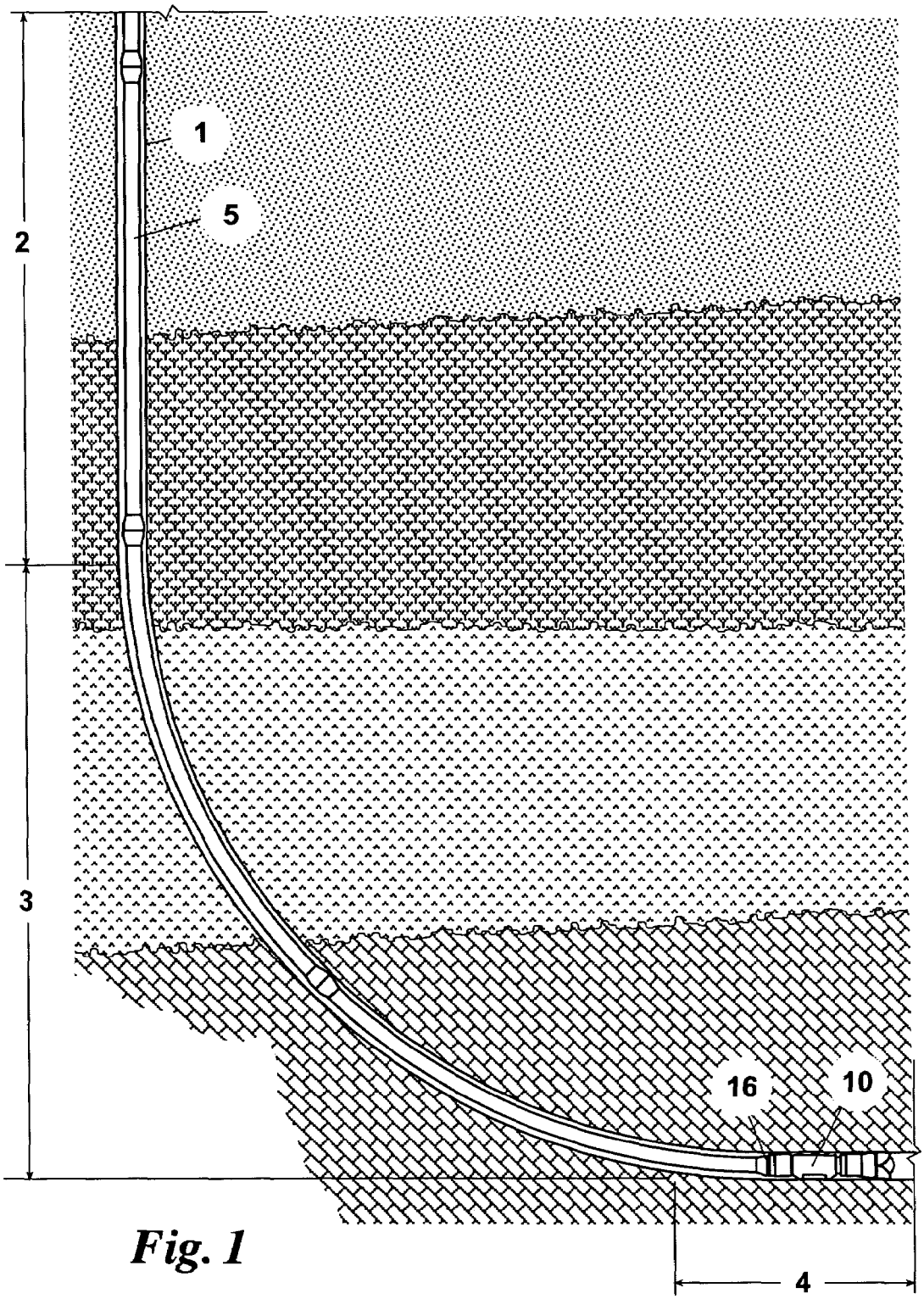
FIG. 1 depicts a drill string employing the present invention on the lower end thereof.

Referring now to FIG. 1, there is shown well bore 1 comprising the vertical borehole 2, non-linear borehole 3, and horizontal borehole 4, described above. Well bore 1 extends downwardly beneath the surface of the ground through numerous and varied subterranean strata, some of which may be oil-bearing. Drill string 5 extends vertically downward in well bore 1 and connects with drill pipe 16. Drill pipe 16, in turn, connects to the improved rotary steerable tool 10 of the present invention.

Figure 2:
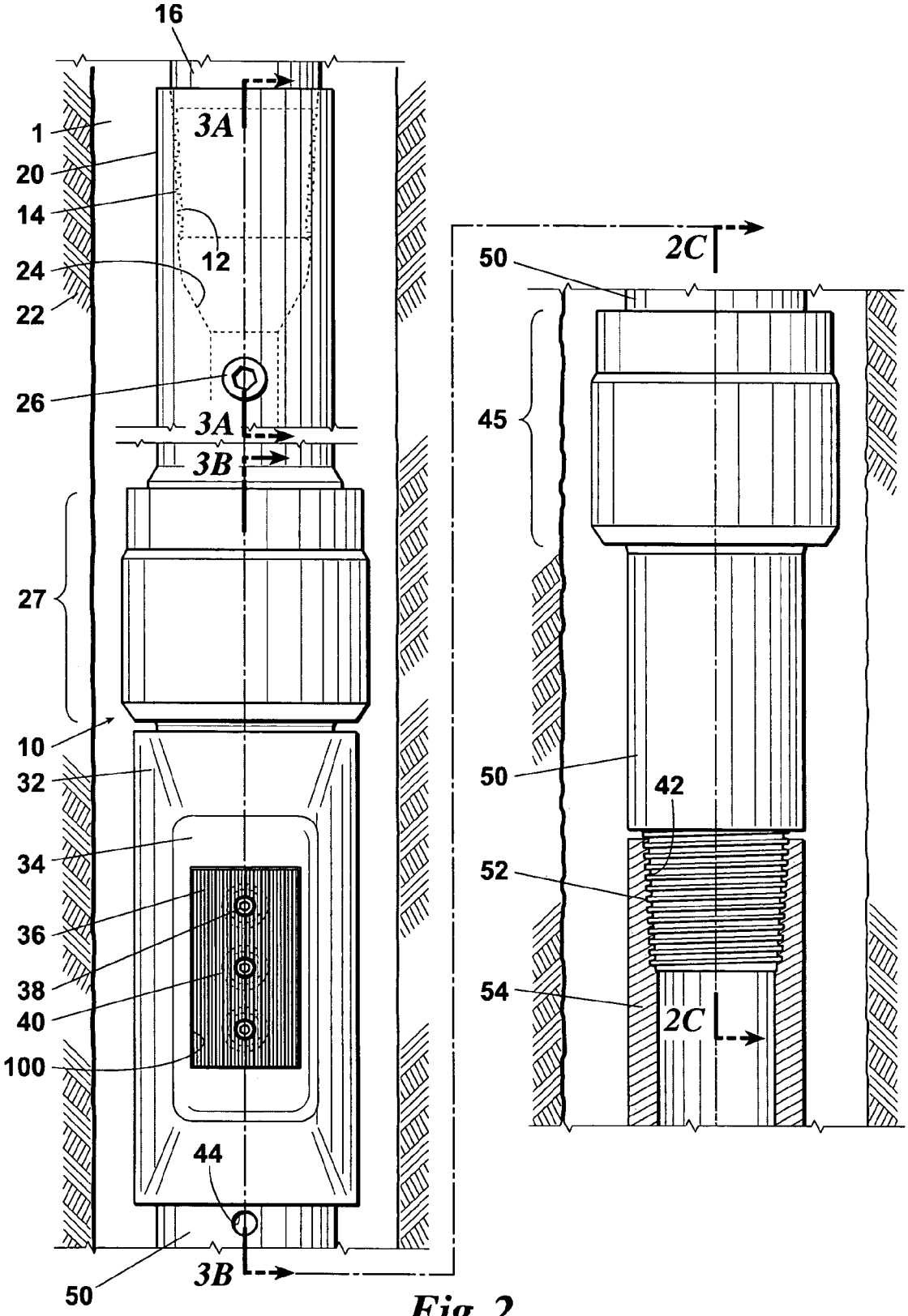
FIG. 2 depicts a longitudinal view of a portion of a drill string embodying the present invention.

FIG. 2 depicts the improved rotary steerable tool 10 of the present invention, which has been modified and ported in a manner later to be described. Rotary steerable tool 10 has upper mandrel 20 with female threads 12 on one end that mate with male threads 14 on the end of a drill pipe, such as drill pipe 16. Rotary steerable tool 10 further comprises lower mandrel 50 with male threads 52 on one end that mate with female threads 42 on the end of a second piece of drill pipe, such as drill pipe 54. Upper mandrel 20 and lower mandrel 50 have an outer cylindrical surface that receives eccentric sleeve 32. Drill pipes 16 and 54 (not shown in further detail) are a portion of a plurality of vertical drill pipes that have been connected together to make a semi-rigid drill string, familiar to those of ordinary skill in the art. Alternatively, drill pipe 54 can be another drill pipe sub-assembly, or a drill motor, including air-driven hammer motors and fluid-driven progressive cavity pumps (commonly known as "mud motors"). Rotary steerable tool 10 is depicted in use within borehole 1 in earth 22, and external bearing assemblies 27 and 45 (described in detail below) isolate drill pipe 54 and rotary steerable tool 10 from borehole 1.

The interior of upper mandrel 20 is hollow, forming an upper bore 24. The end of upper bore 24 adjacent to female threads 12 is funnel shaped in the current embodiment. Alignment lug 26 is inserted into hole 56 (not shown), which communicates with upper bore 24. Upper external bearing assembly 27 encircles upper mandrel 20. Eccentric sleeve 32 encircles the lower end of upper mandrel 20 and the upper end of lower mandrel 50. Deflection pad 36 rests in recess 100. Retaining bolts 38 attach pistons 40 to the underside of deflection device 36. The upper end of lower mandrel 50 directly below eccentric sleeve 32 has two holes 44 (only one of which is visible). Lower external bearing assembly 45 encircles lower mandrel 50.

Figure 3B:
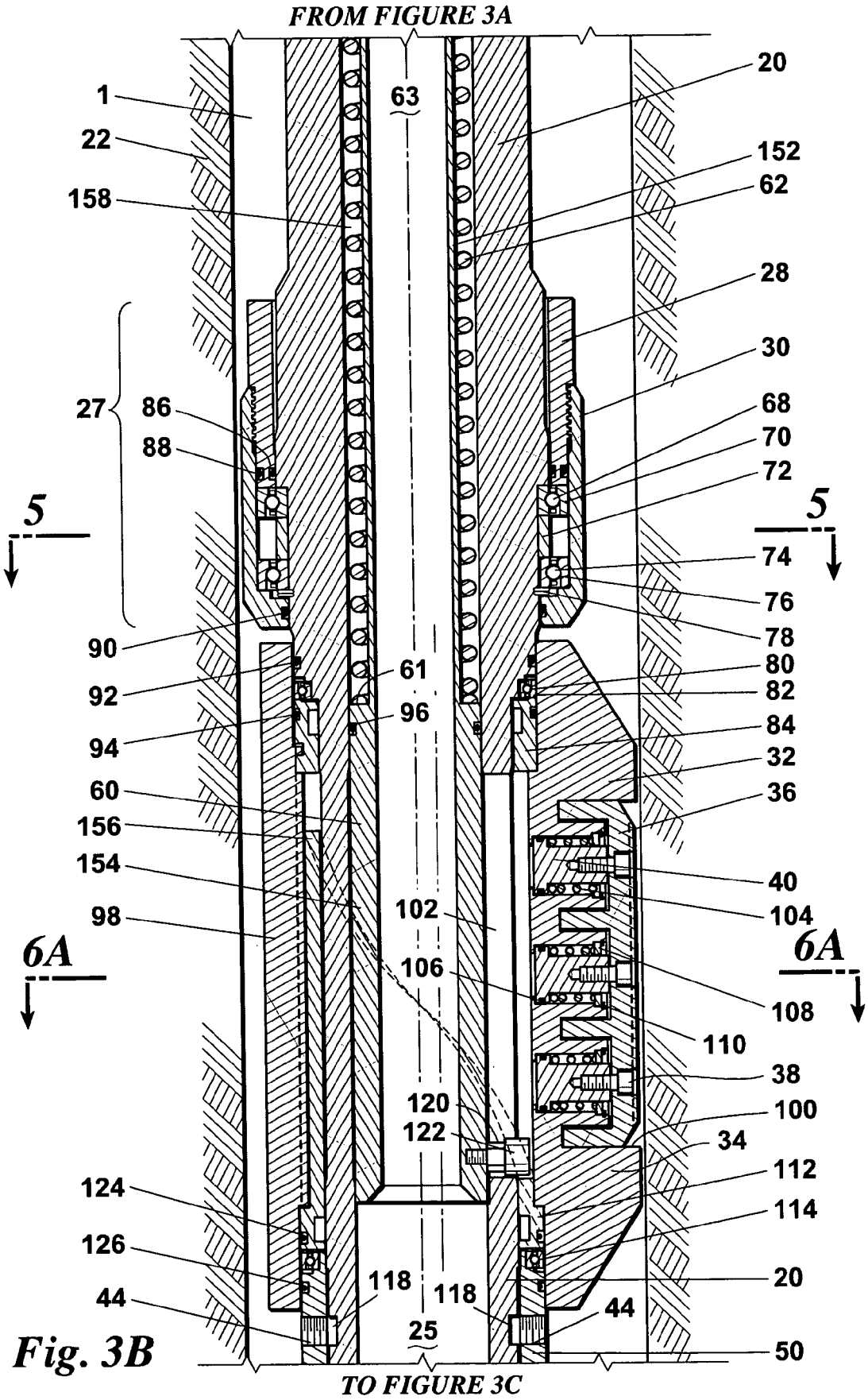
FIG. 3B depicts a longitudinal sectional view taken along line 3B-3B of FIG. 2.
Figure 3C:
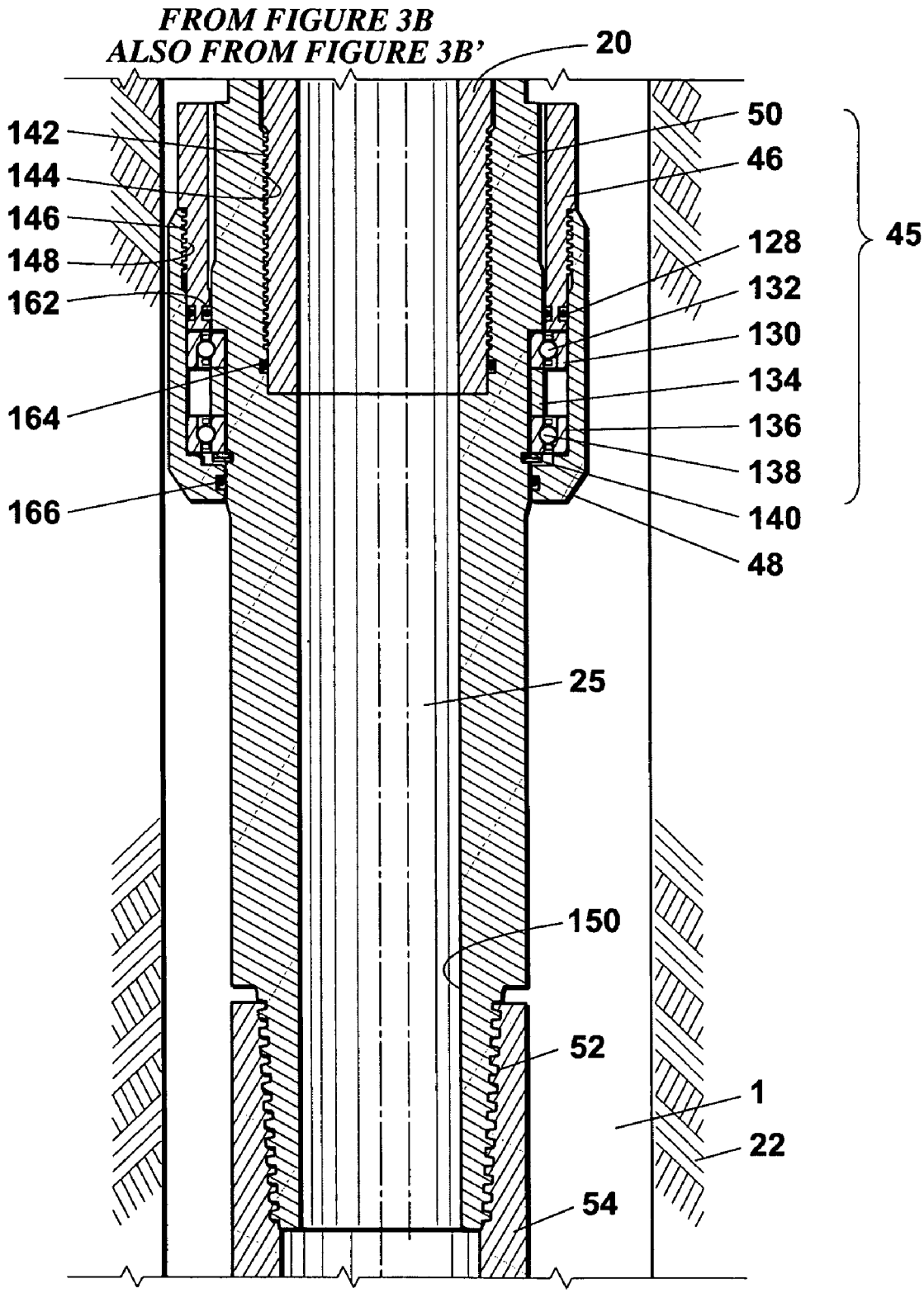
FIG. 3C depicts a longitudinal sectional view taken along line 3C-3C of FIG. 2.
Figure 3A:
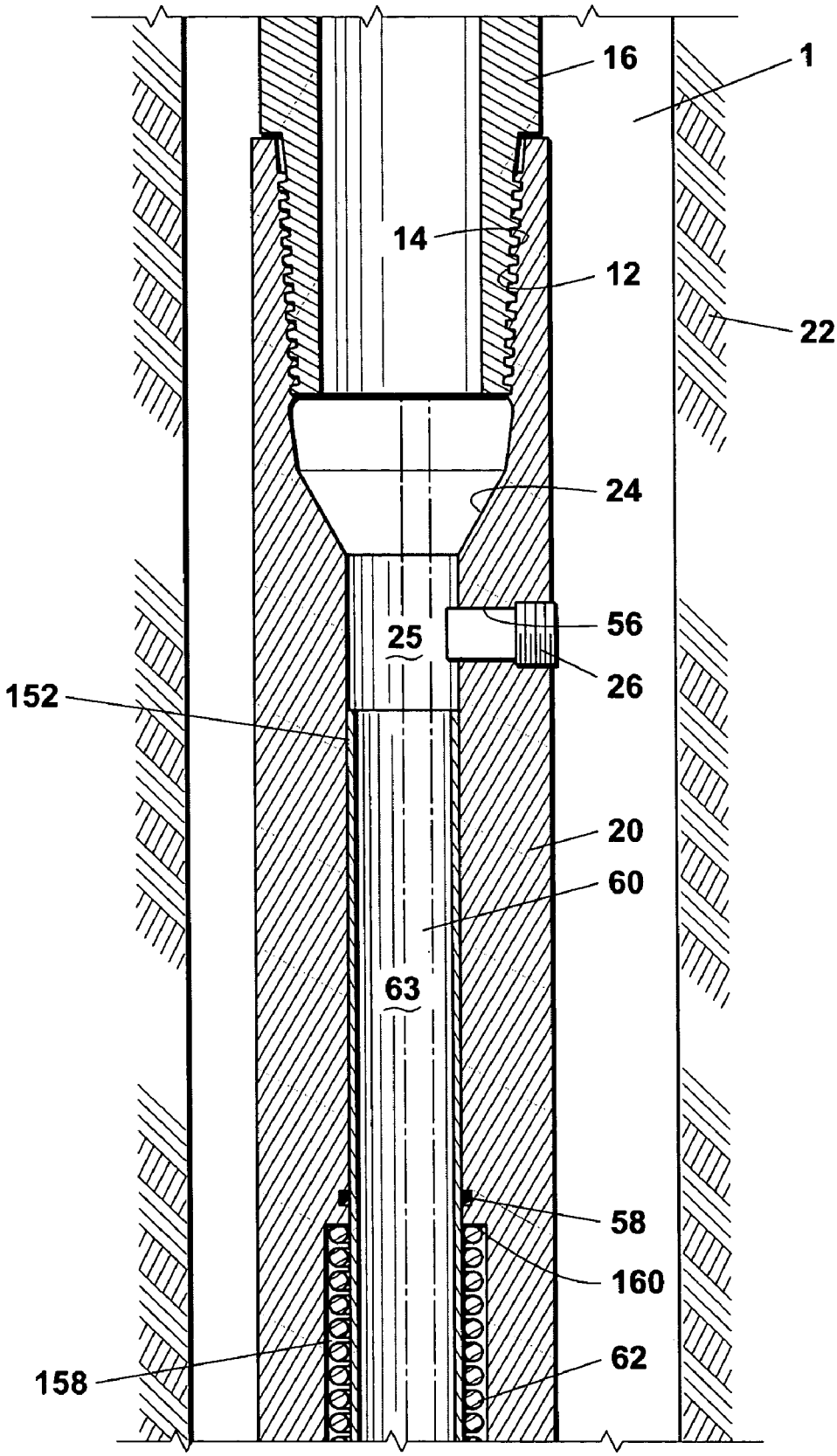
FIG. 3A depicts a longitudinal sectional view taken along line 3A-3A of FIG. 2.
Figure 3B:
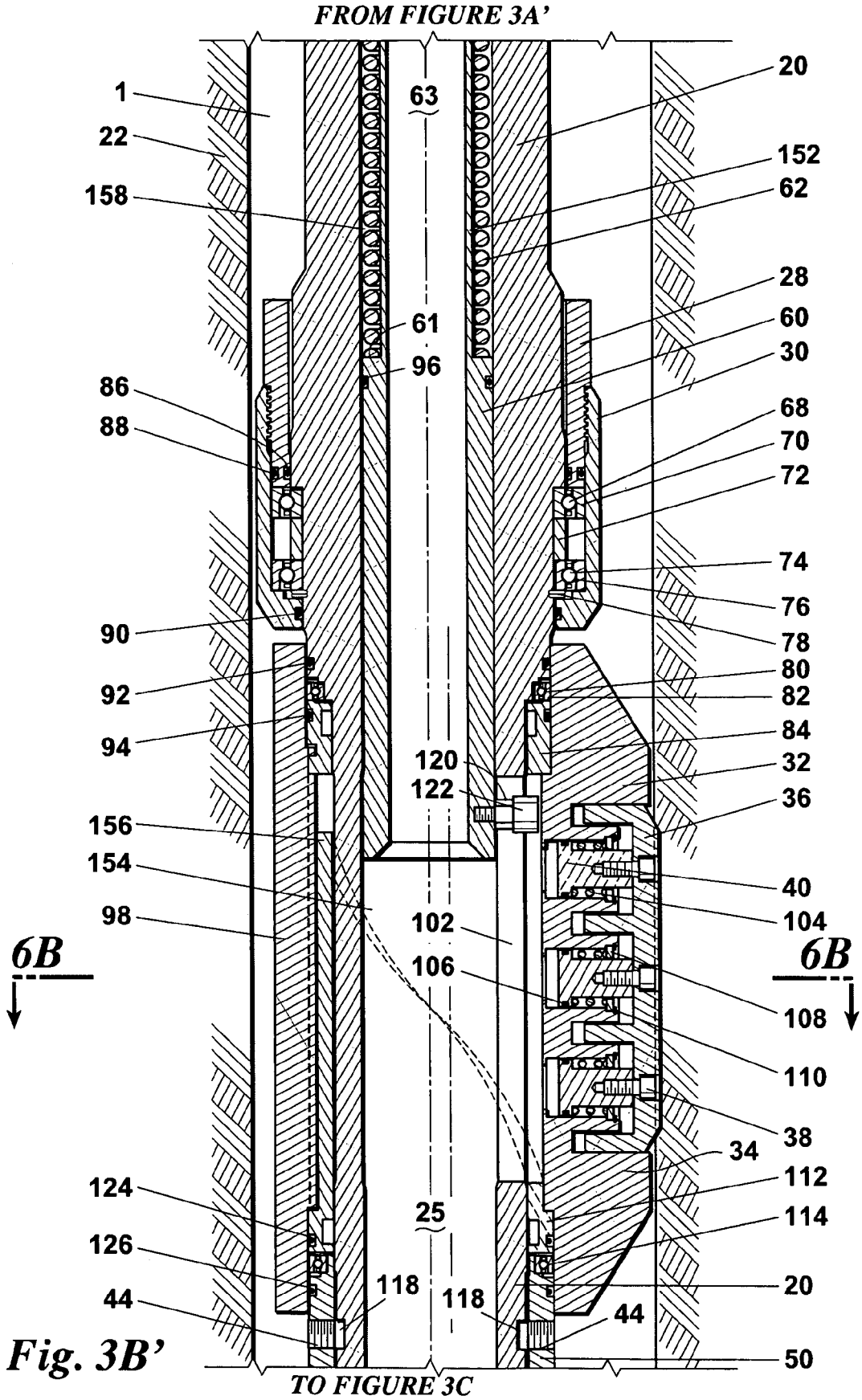

FIG. 3A depicts the upper portion of rotary steerable tool 10. The hollow interior of upper mandrel 20 forms part of mandrel channel 25, which comprises upper bore 24 and lower bore 158. The diameter of upper bore 24 is less than the diameter of lower bore 158, so that mandrel shoulder 160 is formed where upper bore 24 meets lower bore 158 in mandrel channel 25. Alignment lug 56 is located near the joint between rotary steerable tool 10 and upper mandrel 20. Alignment lug 56 extends into mandrel channel 25 and is aligned vertically with deflection pad 36 (see FIG. 2) so that an alignment tool lowered from the surface can engage alignment lug 56 and determine the orientation of deflection pad 36. Control tube 60 is mounted for sliding movement within mandrel channel 25 of upper mandrel 20, making control tube 60 responsive to pressure from fluid flowing through the drill string, as will be described hereinafter. Control tube 60 is hollow, having tube channel 63 that allows fluid to flow freely through control tube 60. Upper portion 152 of control tube 60 is shown, with control spring 62 encircling it within lower bore 158. One end of control spring 62 rests against mandrel shoulder 160. O-ring 58 prevents leakage between upper portion 152 and upper mandrel 20. In comparison to prior art devices such as the rotary steerable tool described in the '321 patent, the orientation of control tube 60 improves the fluid dynamics of drilling fluid as it flows from mandrel channel 25 into tube channel 63 because the diameter of tube channel 63 is substantially the same as that of mandrel channel 25, as seen in FIG. 3A. There is no measurable restriction in the flow of fluid through rotary steerable tool 10.

FIG. 3B depicts the middle portion of rotary steerable tool 10, including eccentric sleeve 32, upper external bearing assembly 27, and lower portion 154 of control tube 60. Also seen in FIG. 3B is alignment sleeve 112, which is fixed rigidly to the inside surface of eccentric sleeve 32. Upper portion 152 of control tube 60 is attached to lower portion 154, which has a larger outer diameter than upper portion 152. The opposing end of control spring 62 rests against tube shoulder 61, which is formed where lower portion 154 meets upper portion 152. O-ring 96 prevents leakage between mandrel channel 25 and lower bore 158. Lower portion 154 has hole 120 in its sidewall. Guide lug 122 is connected to hole 120 through slot 102. Slot 102 is present in the middle portion of the sidewall of upper mandrel 20. In the position shown in FIG. 3B, guide lug 122 also is engaged to alignment sleeve 112 so that control tube 60, upper mandrel 20, lower mandrel 50, alignment sleeve 112, and eccentric sleeve 32 rotate as a single unit with drill pipe 16. Slot 102 is essentially equal in width to the diameter of guide lug 122. The outer end of guide lug 122 terminates at or near the inner surface of eccentric sleeve 32.

FIG. 3B also illustrates components of upper external bearing assembly 27, which includes first collar 28, first sleeve 30, first bearing ring 68, and second bearing ring 74. First spacer 72 separates first bearing ring 68 from second bearing ring 74, and all three components encircle upper mandrel 20 and are enclosed in first sleeve 30. First collar 28 is engaged to first sleeve 30. Second bearing ring 74 rests on retaining clip 78. O-rings 86, 88, and 90 prevent leakage between borehole 1 and the internal components of upper external bearing assembly 27. O-rings used in rotary steerable tool 10, including upper external bearing assembly 27, create a substantially frictionless seal. Low-friction O-rings are available from manufacturers such as Bal Seal Engineering Co. of California. Bearing rings 68 and 74 permit upper mandrel 20 to rotate freely with respect to upper external bearing assembly 27, thereby isolating upper mandrel 20 from borehole 1.

Referring again to FIG. 3B for illustration, eccentric sleeve 32, which has thick wall 34 and thin wall 98, encircles the lower portion of upper mandrel 20 below upper external bearing assembly 27. Eccentric sleeve 32 also encircles second spacer 84, which is positioned between eccentric sleeve 32 and upper mandrel 20. Bearing ring 80 also is positioned between eccentric sleeve 32 and upper mandrel 20, above second spacer 84. Together with bearing ring 114, which is positioned between eccentric sleeve 32 and upper mandrel 20 below alignment sleeve 112, bearing ring 80 provides a low-friction surface that permits upper mandrel 20 to rotate freely with respect to eccentric sleeve 32. O-ring 92 prevents leakage between borehole 1 and bearing ring 80, and O-ring 94 prevents leakage between mandrel channel 25 and bearing ring 80. Thick wall 34 of eccentric sleeve 32 defines recess 100, which could be rectangular or circular in cross-section. Deflection device 36 rests within recess 100 and is attached to pistons 40 by retaining bolts 38, each of which pass through piston chambers in eccentric sleeve 32. The ends of pistons 40 opposing retaining bolts 38 have a slightly larger diameter than the diameter of the body of pistons 40 themselves, thereby creating a shoulder against which piston springs 104 engage pistons 40. O-rings 106 encircle the opposing end of pistons 40, preventing leakage between mandrel channel 25 and the piston chambers. Piston springs 104 encircle pistons 40, with one end resting against washers 108, and urge pistons 40 inwardly. Retaining ring 110 secures washer 108 against piston spring 104.

Alignment sleeve 112 is hollow and has sloped surface 156 encircling the lower portion of upper mandrel 20 and lower portion 154 of control tube 60. Sloped surface 156 terminates in a tip or point, and in side elevation, appears to be generally elliptical in shape (see FIG. 7C). O-ring 124 prevents leakage between mandrel channel 25 and bearing ring 114, and O-ring 126 prevents leakage between borehole 1 and bearing ring 114. The upper portion of lower mandrel 50 has two holes 44 in its sidewall 180° apart. Holes 44 provide access to recesses 118 present in the lower portion of upper mandrel 20.

FIG. 3C depicts the lower portion of rotary steerable tool 10. Lower mandrel 50 is hollow with its upper portion joined to the lower portion of upper mandrel 20 by male threads 142 on upper mandrel 20 and female threads 144 within lower mandrel 50. O-ring 164 prevents leakage between borehole 1 and mandrel channel 25. Lower external bearing assembly 45 encircles lower mandrel 50 near the joint between lower mandrel 50 and upper mandrel 20. Lower external bearing assembly 45 is comprised of components similar to the components of upper external bearing assembly. Lower external bearing assembly includes second collar 46, second sleeve 48, third bearing ring 130, and fourth bearing ring 136. Second spacer 134 separates third bearing ring 130 from fourth bearing ring 136, and all three components encircle lower mandrel 50 and are enclosed in second sleeve 48. Second collar 46 is engaged to second sleeve 48. Fourth bearing ring 136 rests on retaining clip 140. O-ring 162 and O-ring 128 prevent leakage between borehole 1 and third bearing ring 130. O-ring 166 prevents leakage between borehole 1 and fourth bearing ring 136. Like bearing rings 68 and 74, bearing rings 130 and 136 permit lower mandrel 50 to rotate with respect to lower external bearing assembly 45, thereby isolating lower mandrel 50 from borehole 1. Threads 52 are present on the lower portion of lower mandrel 50 to connect lower mandrel 50 to the upper portion of drill pipe 54.

FIG. 3A' depicts the upper portion of rotary steerable tool 10 in a pressurized state. As used herein, the term "pressurized state" refers to any state in which the pressure of the fluid flowing through mandrel channel 25 is greater than the pressure that control spring 62 exerts on control tube 60. In operation, fluid is introduced into upper bore 24 of upper mandrel 20 by drill pipe 16. Once sufficient pressure accumulates to overcome control spring 62, control tube 60 is pushed towards the upper portion of upper mandrel 20, compressing control spring 62.

FIG. 3B' also depicts a portion of rotary steerable tool 10 in a pressurized state. As lower portion 154 of control tube 60 translates upward in upper mandrel 20, guide lug 122 in hole 120 also translates from the lower end of slot 102 to the upper end of slot 102, and guide lug 122 disengages from alignment sleeve 112. Moreover, as depicted in FIG. 3B', guide lug 122 translates beyond alignment sleeve 112 so that upper mandrel 20 and lower mandrel 50 rotate freely within alignment sleeve 112 and eccentric sleeve 32. The upward movement of control tube 60 permits pressurized fluid to flow through slot 102 and exert pressure on pistons 40. Once sufficient pressure is exerted on pistons 40 to overcome the resistance of piston springs 104, piston springs 104 are compressed between the shoulders of pistons 40 and washers 108, and deflection pad 36 is pushed out from recess 100 in thick wall 34 of eccentric sleeve 32. At this point, deflection pad 36 will bear against the side of borehole 1, locking eccentric sleeve 32 in a fixed lateral position against the side of borehole 1. Deflection pad 36 pushes thin wall 98 of eccentric sleeve 32 toward the side of borehole 1 opposite deflection pad 36, thereby causing the lower end of the drill string to tilt away from the longitudinal axis of borehole 1 above rotary steerable tool 10. Deflection pad 36 also forces external bearing assemblies 27 (see FIG. 3B) and 45 (see FIG. 3C) toward the side of borehole 1 opposite deflection pad 36. Since external bearing assemblies 27 and 45 minimize the contact of borehole 1 with drill pipe 16 and the other components of rotary steerable tool 10, the propensity of rotation forces collapsing deflection pad 36 is reduced in this pressurized state. Moreover, the outer surface of deflection pad 36 can be smooth or grooved, but does not require grooves to keep rotary steerable tool 10 from rotating as the drilling operation proceeds.

Once the back pressure dissipates, control spring 62 returns control tube 60 and guide lug 122 to the positions depicted in FIG. 3B. Alignment sleeve 112 realigns deflection pad 36 and eccentric sleeve 32 into the positions depicted in FIG. 3B as well. Likewise, piston springs 104 return pistons 40 and deflection device 36 to the positions within recess 100 depicted in FIG. 3B. The position of the components depicted in FIG. 3C are unaffected by the presence or absence of back pressure exerted by a fluid within upper bore 24 and lower bore 34 of rotary steerable tool 10.

Figure 4:
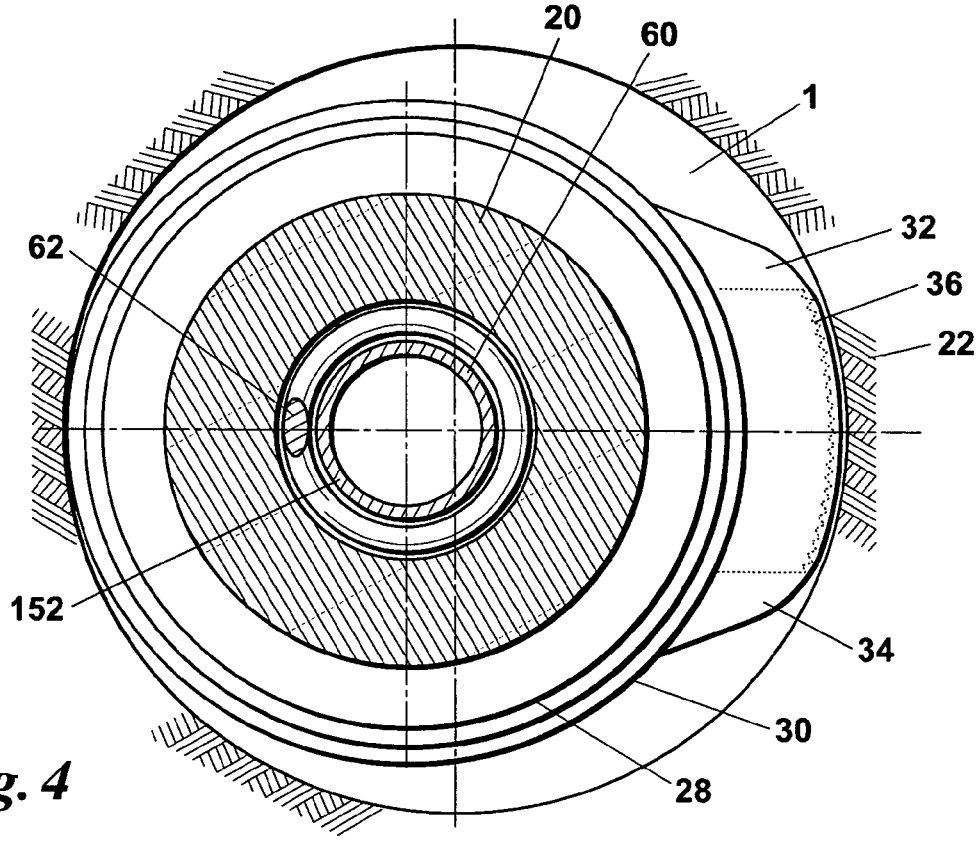
FIG. 4 is a cross-sectional view taken along line 4-4 of FIG. 3A.

FIG. 4 is a cross-sectional view of the upper portion of rotary steerable tool 10 (see FIG. 3A) in an un-pressurized state. Deflection pad 36 resides within thick wall 34 of eccentric sleeve 32. Eccentric sleeve 32 and first sleeve 30 isolate upper mandrel 20 from borehole 1 in earth 22. First collar 28 is attached to first sleeve 30. Control spring 62 encircles upper portion 152 of control tube 60.

Figure 5:
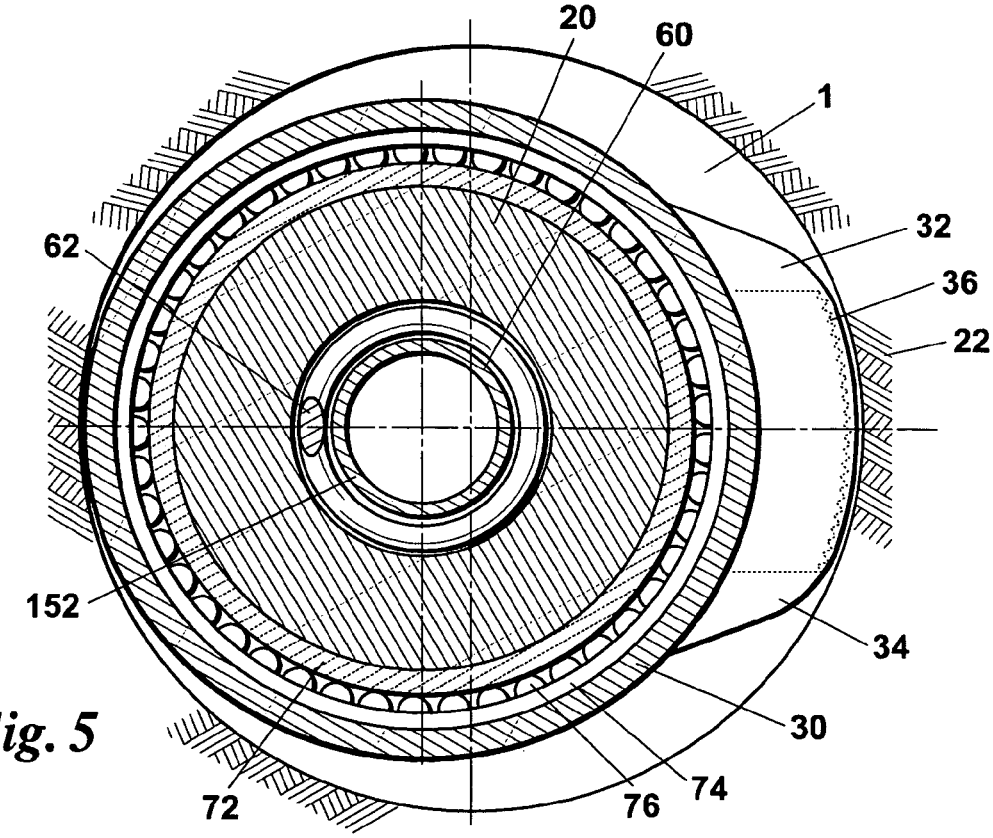
FIG. 5 is a cross-sectional view taken along line 5-5 of FIG. 3B.

FIG. 5 is a cross-sectional view of upper mandrel 20 encircled by first sleeve 30 in an un-pressurized state. Deflection pad 36 resides within thick wall 34 of eccentric sleeve 32. Eccentric sleeve 32 and first sleeve 30 isolate upper mandrel 20 from borehole 1 in earth 22. Bearings 76 within second bearing ring 74 permit upper mandrel 20 to rotate with respect to first sleeve 30. First spacer 72 separates second bearing ring 74 from first bearing ring 68 (not shown). Control spring 62 encircles upper portion 152 of control tube 60.

Figure 6A:
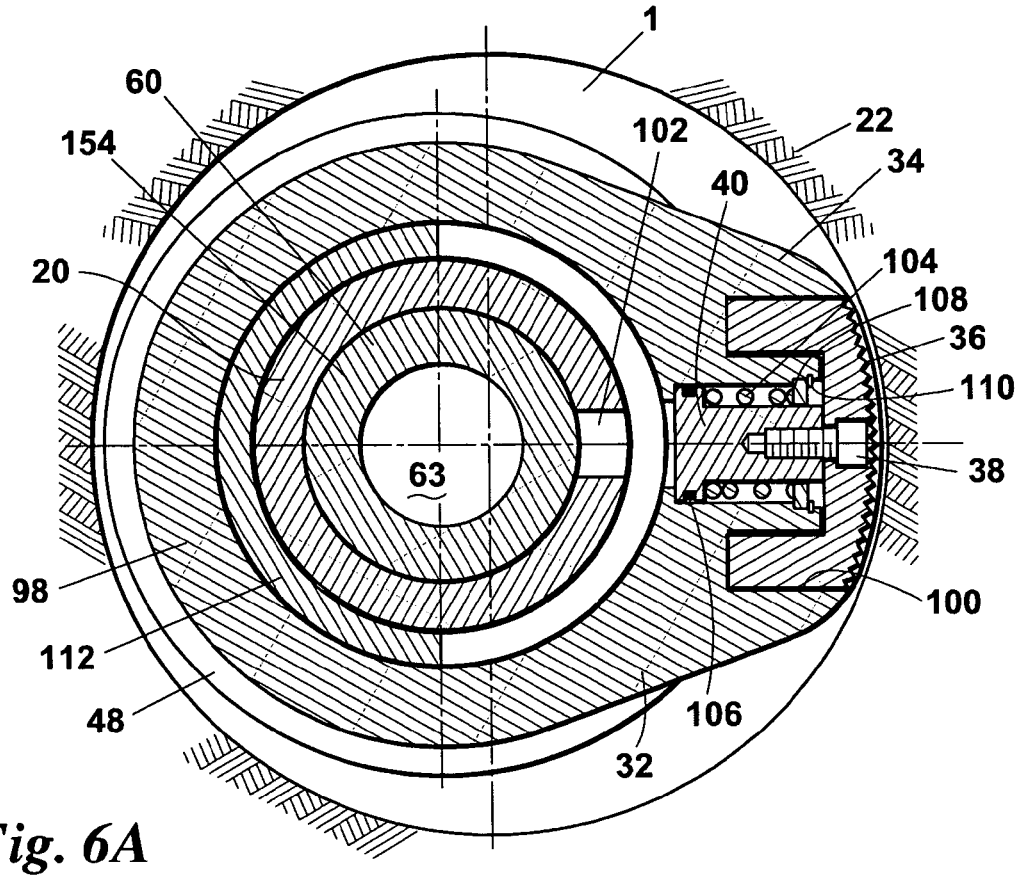
FIG. 6A is a cross-sectional view taken along line 6A-6A of FIG. 3B.

FIG. 6A is a cross-section of upper mandrel 20 encircled by eccentric sleeve 32 in an un-pressurized state. Deflection pad 36 resides within thick wall 34 of eccentric sleeve 32. Retaining bolt 38 attaches deflection pad 36 to piston 40. Piston spring 104 encircles piston 40 and has one end resting against washer 108. Retaining ring 110 secures washer 108 against piston spring 104, and O-ring 106 prevents leakage between piston 40 and eccentric sleeve 32. Eccentric sleeve 32 and second sleeve 48 isolate upper mandrel 20 from borehole 1 in earth 22. Upper mandrel 20 has slot 102 in its sidewall, which is isolated from mandrel channel 25 by control tube 60.

Figure 6B:
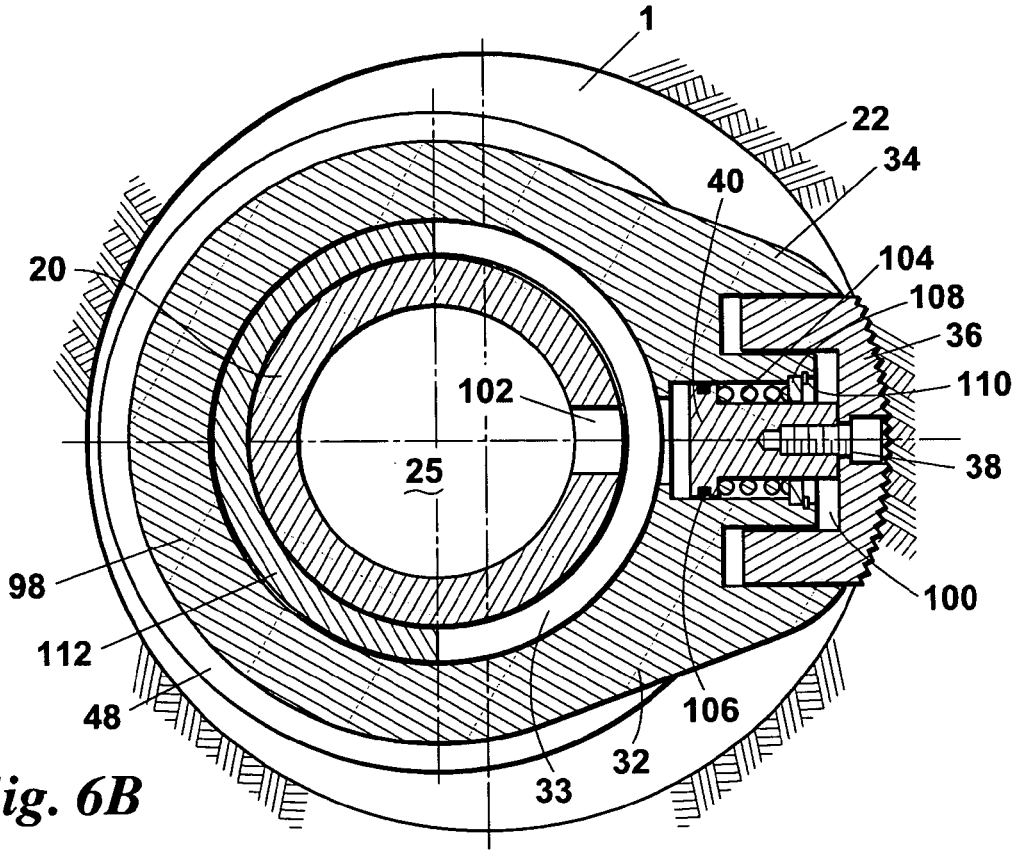
FIG. 6B is a cross-sectional view taken along line 6B-6B of FIG. 3B'.

FIG. 6B is a cross-section of upper mandrel 20 encircled by eccentric sleeve 32 in a pressurized state. Lower portion 154 of control tube 60 (not shown) has been displaced by fluid pressure, exposing fluid in mandrel channel 25 to slot 102 and sleeve channel 33. The fluid then exerts pressure on piston 40, which pushes deflection pad 36 out from recess 100 in thick wall 34 of eccentric sleeve 32. Deflection pad 36 engages one side of borehole 1 in earth 22 and urges thin wall 98 against the opposite side of borehole 1, thereby tilting the drill string away from the longitudinal axis of borehole 1. Retaining bolt 38 attaches deflection pad 36 to piston 40. Piston spring 104 encircles piston 40 and has one end resting against washer 108. O-ring 106 prevents leakage between the piston chamber and mandrel channel 25. Eccentric sleeve 32 and second sleeve 48 isolate upper mandrel 20 from borehole 1 in earth 22. Alignment sleeve 112 is shown partially encircling upper mandrel 20. The translation of lower portion 154 of control tube 60 (not visible) has lifted guide lug 122 above tapered end 156 (see FIG. 3B'), thereby permitting upper mandrel 20 to rotate freely within alignment sleeve 112 and eccentric sleeve 32.

Figure 7A:
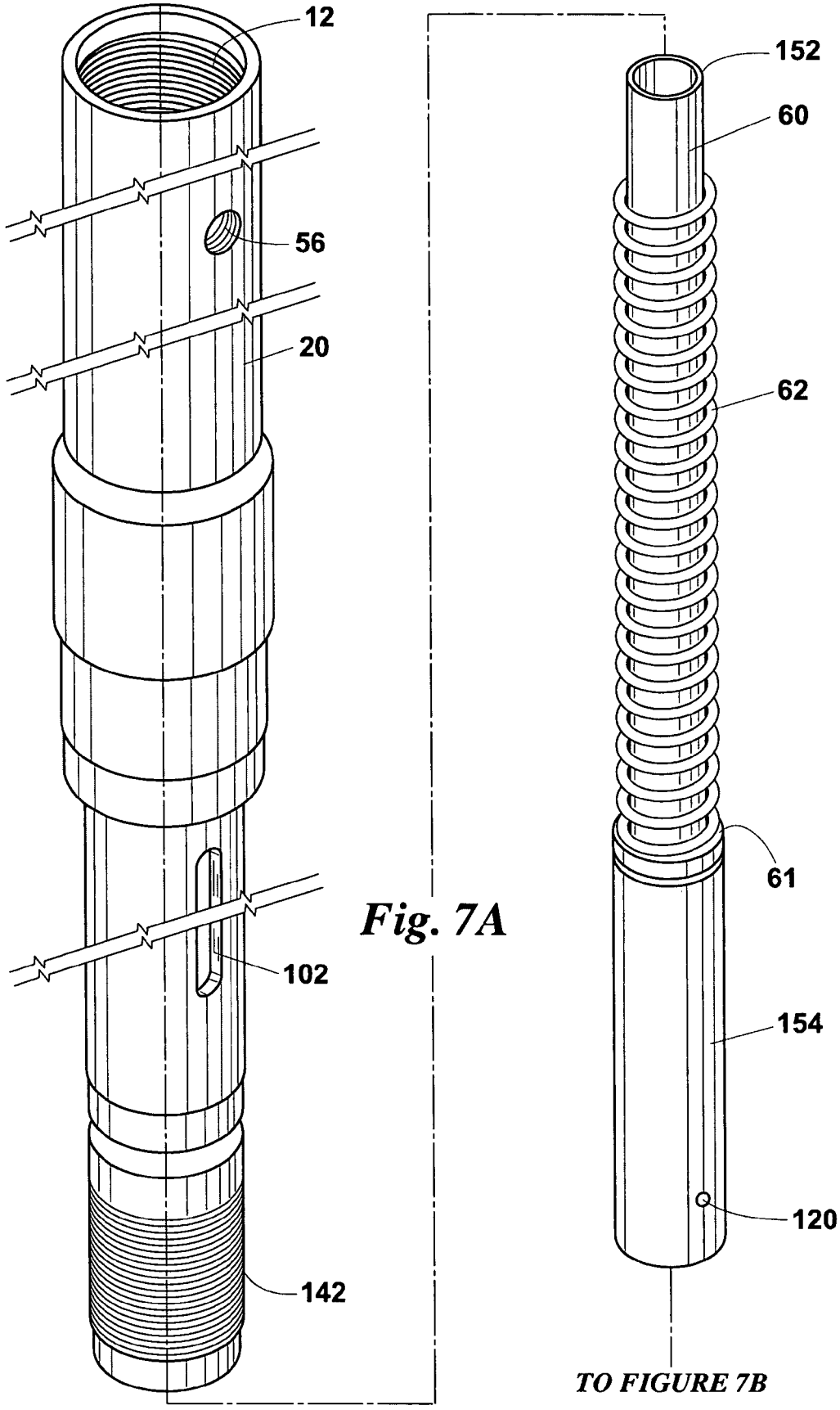
FIG. 7A is a top perspective exploded view of the upper mandrel and sliding tube associated with the present invention.

FIG. 7A is an exploded view of upper mandrel 20 and control tube 60 associated with the present invention. Upper mandrel 20 is hollow with female threads 12 in its interior at one end and male threads 142 on the exterior of the opposing end. Hole 56 is present in its sidewall below female threads 12 for receiving alignment lug 26 (not shown), and slot 102 is present in its sidewall above male threads 142. Hole 56 and slot 102 are vertically aligned with each other. Control tube 60 has control spring 62 encircling upper portion 152. One end of control spring 62 rests against tube shoulder 61 on lower portion 154, which has a larger outer diameter than upper portion 152. Lower portion 154 has hole 120 in its sidewall for receiving guide lug 122 (not shown). Upper portion 152 is inserted into upper mandrel 20 when rotary steerable tool 10 is assembled.

Figure 7B:
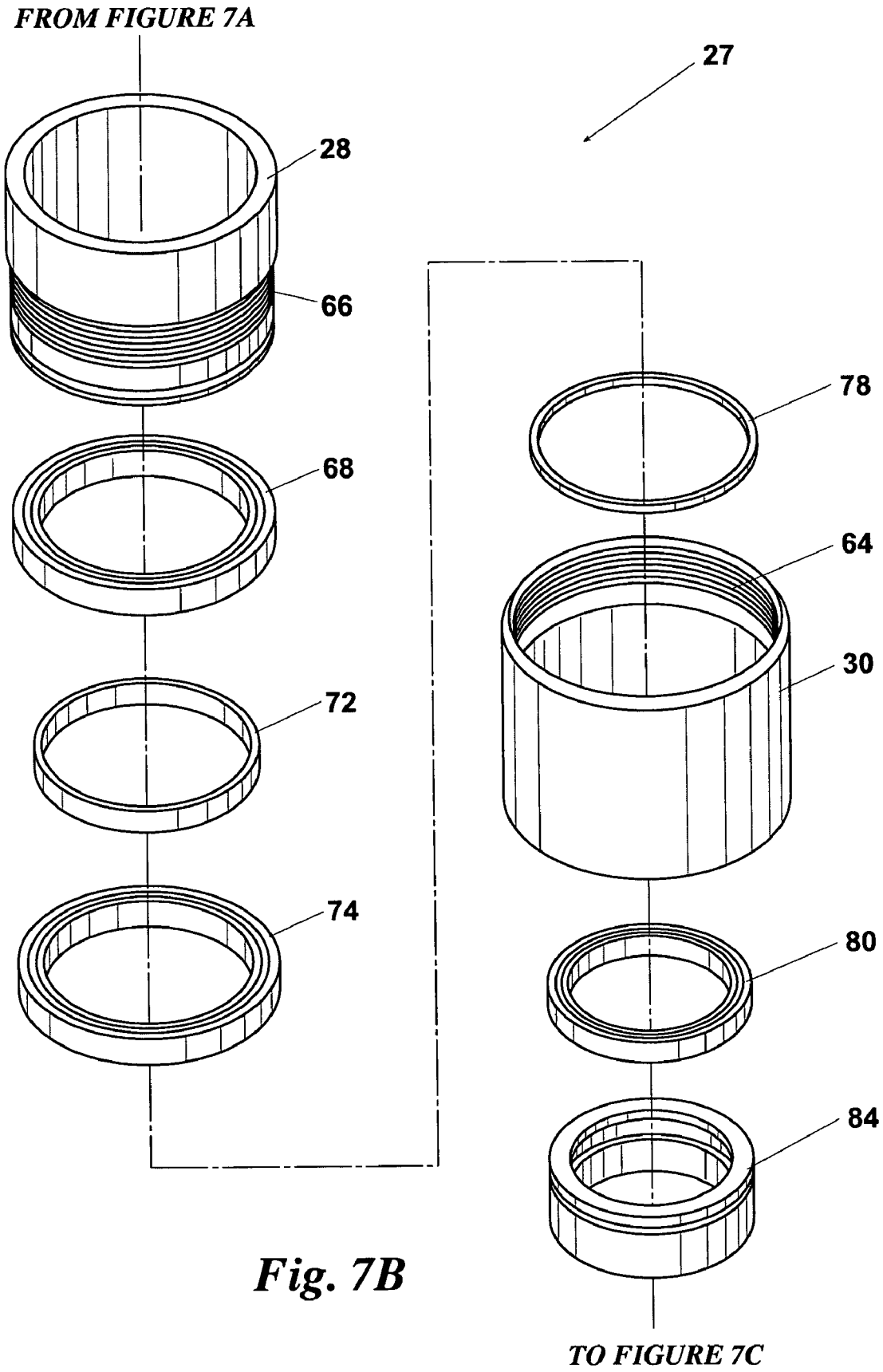
FIG. 7B is a top perspective exploded view of the upper external bearing assembly associated with the present invention.

FIG. 7B is an exploded view of upper external bearing assembly 27 associated with the present invention. First collar 28 has male threads 66 on one end that attach to female threads 64 in one end of first sleeve 30 when rotary steerable tool 10 is assembled. First bearing ring 68 fits below first collar 28 and is separated from second bearing ring 74 by first spacer 72. Second bearing ring 74 is separated from first sleeve 30 by retainer 78. Third bearing ring 80 sits above spacer 84. Third bearing ring 80 separates the upper end of eccentric sleeve 32 from upper mandrel 20 when rotary steerable tool 10 is assembled.

Figure 7C:
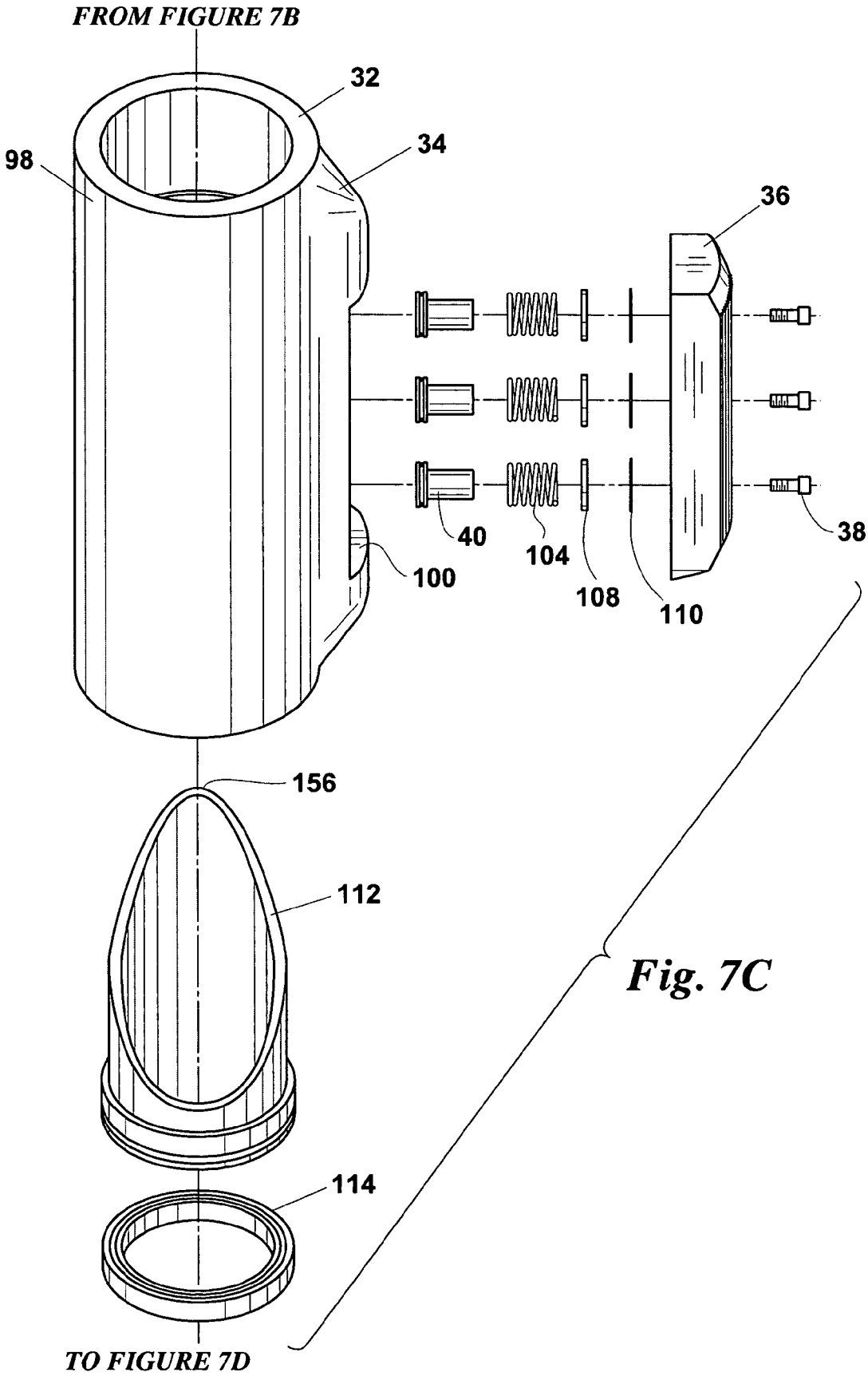
FIG. 7C is a top perspective exploded view of the eccentric sleeve, deflection device, and alignment mechanism associated with the present invention.

FIG. 7C is an exploded view of eccentric sleeve 32, deflection pad 36, and alignment sleeve 112 associated with the present invention. Eccentric sleeve 32 is hollow with recess 100 in thick wall 34. Eccentric sleeve 32 has thin wall 98 opposite thick wall 34. Recess 100 receives pistons 40, piston springs 104, washers 108, retaining rings 110, and deflection pad 36 when rotary steerable tool 10 is assembled. Retaining bolts 38 attach deflection pad 36 to pistons 40. Piston springs 104 exert pressure against the shoulder of pistons 40 to retain deflection device 36 within recess 100 when eccentric sleeve 32 is un-pressurized.

Alignment sleeve 112 has sloped surface 156 on one end and bearing ring 114 beneath its opposing end. Sloped surface 156 terminates in a point and has a generally elliptical shape when viewed at elevation from its side. Alignment sleeve 112 is attached to the inside of eccentric sleeve 32 by any convenient method, such as welding. Alternatively, alignment sleeve 112 and eccentric sleeve 32 can be machined as a single piece.

Figure 7D:
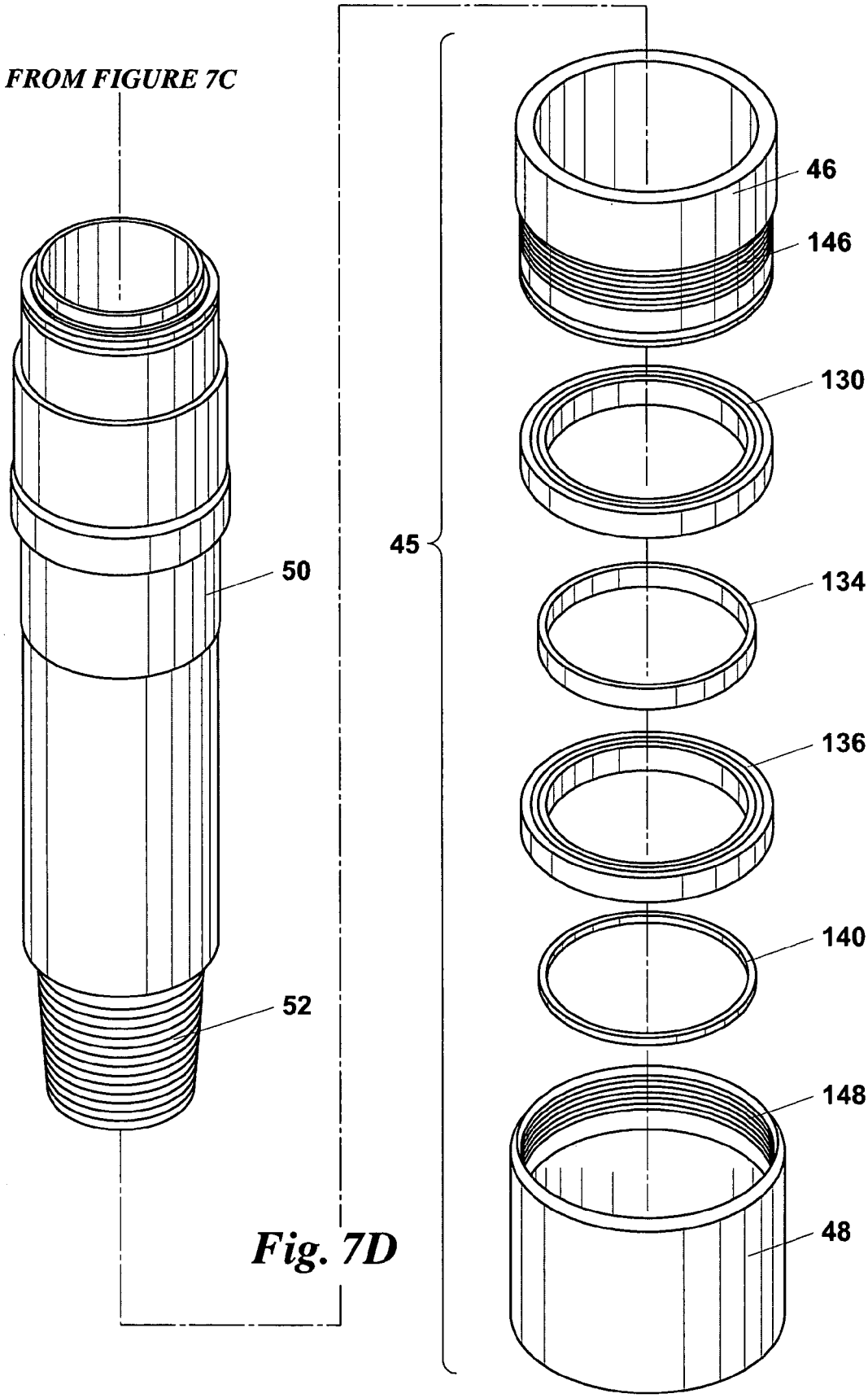
FIG. 7D is a top perspective exploded view of the lower mandrel and lower external bearing assembly associated with the present invention.

FIG. 7D is an exploded view of lower mandrel 50 and lower external bearing assembly 45 associated with the present invention. Lower mandrel 50 is hollow with male threads 52 on the exterior of one end. The end opposite male threads 52 receives male threads 142 of upper mandrel 20 (see FIG. 7A) when rotary steerable tool 10 is assembled. Third collar 46 has male threads 146 on one end that attach to female threads 148 in one end of sleeve 48 when rotary steerable tool 10 is assembled. Third bearing ring 130 fits below collar 46 and is separated from fourth bearing ring 136 by spacer 134. Fourth bearing ring 136 is separated from second sleeve 48 by retainer 140.

With respect to the above description, it is to be realized that the optimum dimensional relationship for the parts of the invention, to include variations in size, materials, shape, form, manner of operation, assembly, and use are deemed readily apparent and obvious to one of ordinary skill in the art. The present invention encompasses all equivalent relationship to those illustrated in the drawings and described in the specification. The novel spirit of the present invention is still embodied by reordering or deleting some of the steps contained in this disclosure. The spirit of the invention is not meant to be limited in any way except by proper construction of the following claims.

What is claimed is:

1. An apparatus for steering an earth-penetrating drill bit, the apparatus comprising:

an eccentric sleeve having a cylindrical bore and a piston chamber, the piston chamber having a port;

a piston spring engaged with the piston chamber;

a piston positioned against the piston spring;

a deflection pad mounted to the piston through the port in the piston chamber;

a mandrel positioned in the eccentric sleeve, the mandrel having a cylindrical bore, and a mandrel shoulder within the cylindrical bore of the mandrel, and a slot that exposes the cylindrical bore of the mandrel to an external surface of the mandrel;

a control spring positioned in the cylindrical bore of the mandrel so that the mandrel shoulder engages an end of the control spring;

a control tube positioned in the mandrel so that the control spring engages the control tube and exerts a force on the control tube that urges the control tube vertically downward;

wherein the control tube, in response to an increasing back pressure of drilling fluid in the mandrel, moves upwardly against the force of the control spring, thereby exposing the piston to the drilling fluid through the slot in the mandrel and causing the deflection pad to move outward in response to the increasing pressure of the drilling fluid;

wherein the increasing back pressure is enabled by a seal between an upper portion and an upper mandrel.

2. The apparatus of claim 1 further comprising:

an alignment sleeve mounted to the eccentric sleeve and positioned between the eccentric sleeve and the mandrel, the alignment sleeve having a proximate end, a length less than the length of the slot, and a distal end having a sloped surface; and a guide lug fixed to the control tube;

wherein the guide lug engages the slot in the mandrel and engages the sloped surface of the alignment sleeve so that, in response to increasing pressure of drilling fluid in the mandrel, the guide lug so fixed to the control tube moves upwardly in the slot to a position beyond the distal end, so that the mandrel rotates free of the eccentric sleeve, and in response to subsequent decreasing pressure of drilling fluid in the mandrel, the guide moves downwardly and engages the sloped surface of the alignment sleeve, so that the eccentric sleeve so mounted to the alignment sleeve rotates to a known position with respect to the mandrel.

3. The apparatus of claim 1 further comprising:

a first external bearing assembly encircling the mandrel above the eccentric sleeve; and a second external bearing assembly encircling the mandrel below the eccentric sleeve;

whereby the first and second external bearing assemblies isolate the mandrel from a borehole wall and provide surfaces against which the mandrel rotates so that the mandrel rotates freely within the first and second bearing assemblies.

4. The apparatus of claim 2 further comprising:

a first external bearing assembly encircling the mandrel above the eccentric sleeve; and a second external bearing assembly encircling the mandrel below the eccentric sleeve;

whereby the first and second external bearing assemblies isolate the mandrel from a borehole wall and provide surfaces against which the mandrel rotates so that the mandrel rotates freely within the first and second bearing assemblies.

5. The apparatus of claim 3 wherein the first external bearing assembly comprises a first isolation sleeve encircling the mandrel above the eccentric sleeve, and a first bearing ring positioned between the first isolation sleeve and the mandrel; and the second external bearing assembly comprises a second isolation sleeve encircling the mandrel below the eccentric sleeve, and a second bearing ring positioned between the second isolation sleeve and the mandrel; whereby the first and second bearing rings provide the surface against which the mandrel rotates so that the mandrel rotates freely within the first and second isolation sleeves.

6. The apparatus of claim 4 wherein the first external bearing assembly comprises a first isolation sleeve encircling the mandrel above the eccentric sleeve, and a first bearing ring positioned between the first isolation sleeve and the mandrel; and the second external bearing assembly comprises a second isolation sleeve encircling the mandrel below the eccentric sleeve, and a second bearing ring positioned between the second isolation sleeve and the mandrel; whereby the first and second bearing rings provide the surface against which the mandrel rotates so that the mandrel rotates freely within the first and second isolation sleeves.

7. The apparatus of claim 3 further comprising a fluid conducting flexible joint between the mandrel and the drill bit for facilitating the tilting of the drill bit.

8. The apparatus of claim 4 further comprising a fluid conducting flexible joint between the mandrel and the drill bit for facilitating the tilting of the drill bit.

9. An apparatus for steering an earth-penetrating drill bit, the apparatus comprising:

a mandrel having a mandrel channel;

an eccentric sleeve encircling the mandrel;

a piston chamber in the eccentric sleeve;

a piston in the piston chamber;

a means for engaging the piston in the piston chamber so that the piston reciprocates within the piston chamber in response to changes in pressure in the piston chamber;

a fluid channel between the mandrel channel and the piston chamber;

a deflection pad;

a means for attaching the deflection pad to the piston;

a control means for opening and closing the fluid channel between the mandrel channel and the piston chamber;

whereby the control means, in response to an increasing back pressure of a drilling fluid in the mandrel channel exposes the piston to the drilling fluid through fluid channel, and causes the deflection pad to move outward in response to the increasing pressure of the drilling fluid;

wherein the increasing back pressure is enabled by a seal between an upper portion and an upper mandrel.

10. The apparatus of claim 9 further comprising:

an alignment means for rotating the eccentric sleeve to a known position with respect to the mandrel.

11. The apparatus of claim 9 further comprising:

a first isolation means for isolating the mandrel from a borehole surface above the eccentric sleeve; and a second isolation means for isolating the mandrel from the borehole surface below the eccentric sleeve.

12. The apparatus of claim 10 further comprising:

a first isolation means for isolating the mandrel from a borehole surface above the eccentric sleeve; and a second isolation means for isolating the mandrel from the borehole surface below the eccentric sleeve.

13. An apparatus for causing a drill bit to drill a curved planar borehole, wherein the drill bit is mounted at the lower end of a drill string which extends downwardly into the borehole, a drilling motor also being mounted adjacent the lower end of the drill string above the drill bit for rotating the same, a specialized drill pipe sub-assembly mounted in the drill string above the drilling motor, a fluid conducting flexible joint connected between the specialized drill pipe sub-assembly and the drill string for facilitating the tilting of the lower end of the drill string when the drill string adjacent to the specialized drill sub is pushed from one side of the borehole towards the opposite side, the specialized sub-assembly including a mandrel having an outer cylindrical surface whose diameter is less than the normal outer diameter of adjacent sections of the drill string and which extends for substantially the full length of the sub-assembly, an eccentric sleeve which is adapted to be mounted over the mandrel to rotate eccentrically with respect to the mandrel, the eccentric sleeve having an inner diameter greater than the outer diameter of the mandrel so as to form an annular space between the mandrel and the eccentric sleeve, an alignment mechanism in the form of a thin sleeve mounted within the annular space and being attached to the eccentric sleeve, the eccentric sleeve having a thick wall and a thin wall, a deflection device mounted in the thick wall of the eccentric sleeve and adapted to bear against one side of the borehole so as to urge the thin wall of the eccentric sleeve against the opposite side of the borehole, thereby tilting the drill string away from the longitudinal axis of the borehole, the mandrel having an inner bore for conducting pressurized fluid, a control tube received within the inner bore of the mandrel for vertical sliding movement therein, a control spring for urging the control tube vertically downward, a piston extending laterally through the thick wall of the eccentric sleeve and connecting with the deflection device for urging the deflection device against one side of the borehole, a retaining plug mounted on an end of the piston opposite from the attachment thereof to the deflection device, a piston spring mounted between the retaining plug and the thick wall of the eccentric sleeve for urging the piston inwardly, the control tube having a laterally extending guide key received in a guide slot in the mandrel, the alignment mechanism having a notch in one side thereof adjacent the location of the piston for receiving the guide key therein, the alignment mechanism having an upper tip on the opposite side of the alignment mechanism from the notch and extending upwardly to a location opposite the upper end of the guide slot in the mandrel, whereby, when fluid under pressure is introduced into the drill pipe sub-assembly, the control tube will move upwardly against the action of the control spring in response to an increasing back pressure of drilling fluid, the guide key moving to the upper end of the guide slot in a position laterally above the upper tip of the alignment mechanism, the fluid pressure also acting on the retaining plug to push the piston outwardly and thereby push the deflection device against the side of the borehole, the fluid pressure also actuating the drilling motor for rotating the drill bit, the location of the guide key above the tip of the alignment mechanism being such that the mandrel can rotate independently of the eccentric sleeve to prevent reactive torque from the drilling motor from being exerted against the sleeve and the deflection device; and wherein the increasing back pressure is enabled by a seal between an upper portion and an upper mandrel.

* * * * *